US007770313B2

(12) United States Patent
Fritsche

(10) Patent No.: US 7,770,313 B2
(45) Date of Patent: Aug. 10, 2010

(54) CURVED END PANEL FOR POP-UP DISPLAYS

(75) Inventor: Mark A. Fritsche, Eagan, MN (US)

(73) Assignee: Skyline Displays, Inc., Eagan, MN (US)

( * ) Notice: Subject to any disclaimer, the term of this patent is extended or adjusted under 35 U.S.C. 154(b) by 193 days.

(21) Appl. No.: 11/646,868

(22) Filed: Dec. 28, 2006

(65) Prior Publication Data

US 2008/0155873 A1 Jul. 3, 2008

(51) Int. Cl.
*G09F 15/00* (2006.01)

(52) U.S. Cl. ..... 40/610; 40/600; 40/605; 40/606.12

(58) Field of Classification Search ..... 40/610, 40/603, 604, 611.01, 605, 606.12, 600; 160/329, 160/354; 428/900
See application file for complete search history.

(56) References Cited

U.S. PATENT DOCUMENTS

| | | | | | |
|---|---|---|---|---|---|
| 4,471,548 | A * | 9/1984 | Goudie | 40/610 |
| 4,658,560 | A * | 4/1987 | Beaulieu | 52/646 |
| 4,979,554 | A * | 12/1990 | Nelson | 160/135 |
| 5,148,648 | A | 9/1992 | Sorenson et al. | |
| 5,203,126 | A | 4/1993 | Sorenson et al. | |
| 5,203,134 | A | 4/1993 | Sorenson et al. | |
| 5,439,043 | A * | 8/1995 | Carter | 160/135 |
| 5,584,547 | A * | 12/1996 | Trulaske, Sr. | 312/223.5 |
| 5,988,255 | A * | 11/1999 | Wigglesworth, III | 160/135 |
| 6,553,724 | B1 | 4/2003 | Bigler | |
| 6,829,869 | B1 | 12/2004 | Savoie | |
| 6,836,988 | B2 | 1/2005 | Zarelius | |
| 7,020,993 | B2 * | 4/2006 | Pritchard | 40/610 |
| 7,134,230 | B1 * | 11/2006 | Boens et al. | 40/610 |
| 7,253,544 | B2 * | 8/2007 | Wang | 310/90.5 |
| 2004/0006902 | A1 | 1/2004 | Zarelius | |
| 2005/0166430 | A1 | 8/2005 | Zarelius | |

FOREIGN PATENT DOCUMENTS

| | | |
|---|---|---|
| WO | WO 95/10104 | 4/1995 |
| WO | WO 97/03431 | 1/1997 |
| WO | WO 01/91092 A1 | 3/2001 |
| WO | WO 01/35381 A1 | 5/2001 |

* cited by examiner

*Primary Examiner*—Lesley Morris
*Assistant Examiner*—Christopher E Veraa
(74) *Attorney, Agent, or Firm*—Patterson Thuente Christensen Pedersen, P.A.

(57) ABSTRACT

A display for tradeshows and the like, the display having a framework configurable between erected and collapsed configurations, wherein when in the erected configuration, the framework includes a front, opposed ends, and vertical elongate members presented with the framework proximate the ends. A pair of resiliently flexible end panels can be removably wrapped around the ends of the framework in a flexed position. The panels having a vertical end panel magnetic strips operably magnetically engageable with one of the elongate members. Front display panels, also with magnetic strips, can be engaged with vertical elongate members. The end panels can be secured in place by being at least partially sandwiched between the magnetic strip of front panels and the vertical elongate member.

17 Claims, 20 Drawing Sheets

CURVED END PANEL FOR POP-UP DISPLAYS

FIELD OF THE INVENTION

This invention generally relates to collapsible displays configurable between an open, erected configuration for displaying graphics thereon and a closed, collapsed configuration for storage and transportation. More particularly, this invention relates to a curved end panel for collapsible displays.

BACKGROUND OF THE INVENTION

Trade show displays are often collapsible, transportable, and can support visual graphics for viewing by attendees. One such display includes a framework structure made of a network of support rods pivotally attached to hubs that is erectable into a three-dimensional space. The expanded structure can be covered with face panels presented on the front and/or back of the framework and wrap-around curved end panels extending around ends of the framework, the panels having graphics thereon providing a continuous flowing surface and a curved termination to the display.

Vertical braces can be included to support the framework structure in the erected configuration. The braces can include magnetized strips thereon for coupling with magnetic strips included on the front and end panels. The display is erected by opening the framework structure, attaching the braces having magnetic strips to the front and/or back of the support structure, and attaching the display panels by contacting the magnets on the panels to the magnetized strips on the braces. The wrap-around end panels are attached by manually curving the end panel along the length-wise axis of the panel and attaching the magnets on the end panel to the magnetic strips on front and rear braces proximate the ends of the display.

The front and end panels conventionally comprise resilient fabric, carpet, or sheet material, such as laminated polycarbonate sheets. When the end panels, such as the laminated polycarbonate sheets, are wrapped around the ends to provide curved end panels, they can have stored potential energy and can have a significant bias to return to their original, flat configuration. Also the resiliency can cause difficulties in placing the curved panel on the braces.

Normally, to attach the end panel, a user often must start at the top (or bottom) of the display and simultaneously place the magnets on the panel on the brace magnets and slowly moving downwardly (or upwardly) while mating the magnets on the panel with the magnets on the braces. This can be inconvenient and require a substantial amount of time. Further, if one or both sides fall off during this assembly process, the user must usually start from the beginning to attach the end panel.

Once the curved panels are curved and placed upon the ends of the framework, the stored potential energy can cause disengagement from the framework when the end panels are released from the framework. If someone walks by the display and incidentally bumps the end panel, the force of the bump can be enough to decouple the end panel magnet from a brace magnet. Once this occurs, the curved end panel seeks to quickly return to its flat, uncurved original shape and thereby falls off of the display. The user must then reinstall the end panel on the display.

There is therefore a need for an improved display overcoming the deficiencies of conventional display designs.

BRIEF SUMMARY

The collapsible display of various embodiments can include a magnet configuration enabling improved coupling between end panels and channel bars or braces. Such a collapsible display can include a framework configurable between erected and collapsed configurations, wherein when in the erected configuration the framework can include a front and opposed ends and has a height. The display can include an elongate vertical member associated with the framework proximate one of the ends when in the open configuration, the vertical member can extend substantially the height of the erected framework. The display can further include an end panel curvable around and thereby concealing the one of the ends of the framework, the end panel including an end panel magnet operably engageable with the elongate member. The display can further include a front panel engageable with and thereby concealing at least a portion of the front of the framework, the front panel including a front panel magnet engageable with the end panel magnet, such that the end panel magnet can be operably sandwiched intermediate the elongate member and the front panel magnet.

A panel set for a collapsible framework having a front and opposed ends and a vertical member presented therewith proximate one of the ends. The panel set according to an embodiment can include an end panel concealing an end of a framework, the end panel including a resilient sheet portion with four side edges and an end panel magnet along one of said side edges, the resilient sheet portion flexible between a flat unflexed position and a curved flexed position for wrapping around one of the end of the framework, the magnet having a portion overlapping the resilient sheet portion and having a portion extending outwardly from the overlapping portion and not overlapping said resilient sheet portion, the end panel magnet operably magnetically engageable with the vertical member presented with the framework proximate the end. The panel set can further include a front panel attachable to at least a portion of a front of the framework, the front panel including a resilient sheet portion and a front panel magnet selectively engageable with the end panel magnet, such that the end panel magnet can be in overlapping engagement with the front panel magnet.

A method of setting up a display according to an embodiment can include providing a framework configurable between open and closed configurations, wherein when in the open configuration the framework can include a front and opposed ends, presenting an elongate vertical member with the framework proximate one of the ends when in the open configuration, concealing the one of the ends of the framework with an end panel including an end panel magnet thereon by operably engaging the end panel magnet with the elongate vertical member, and concealing at least a portion of the front of the framework with a front panel including a front panel magnet by operably engaging the front panel magnet with the end panel magnet and operably sandwiching the end panel magnet intermediate the elongate vertical member and the front panel magnet.

A display according to a further embodiment can include a framework configurable between erected open and collapsed transport configurations, wherein when in the erected open configuration the framework can include a front and primarily vertically extending opposed ends, an elongate member coupleable in a vertical position with the framework proximate one of the ends when in the open configuration. The display further can include a resiliently flexible end panel concealing the one of the ends of the framework, the end panel having inner and outer surfaces and opposed end panel margins, the end panel including an end panel magnet including first and second portions, the first portion being coupled with the inner surface of the end panel proximate one of the end panel margins and the second portion extending beyond the end panel margin, wherein the end panel magnet can be magnetically engageable with the elongate member. The display further can include a front panel attachable to the framework thereby concealing at least a portion of the front of the framework, the front panel having opposed front and rear surfaces and opposed front panel margins, the front panel including a front panel magnet presented with the rear surface of the front panel proximate one of the front panel margins, wherein a major surface of the front panel magnet can be selectively engageable with the portion of the end panel magnet extending beyond the end panel end margin, such that a substantially continuous display can be presented on the framework between the front and end panels.

A display for tradeshows and the like according to a yet another embodiment can include a framework configurable between an erected open and closed configurations, wherein when in the erected configuration the framework can include a front and opposed ends. The display can further include a support means presented with the framework proximate one of the ends when in the open configuration. The display can further include a first concealing means configured to conceal the one of the ends of the framework, the first concealing means including a first attachment means operably engageable with the support means, and a second concealing means concealing at least a portion of the front of the framework. The display can further include a second concealing means including a second attachment means selectively engageable with the first attachment means, such that the first attachment means can be operably sandwiched intermediate the support means and the second attachment means.

A method of retrofitting an end panel for concealing an end of collapsible tradeshow display framework according to an embodiment can include providing an end panel including a resilient end panel sheet portion with four side edges and a first magnet strip along one of said side edges, such that the first magnet strip overlaps the resilient sheet portion, the resilient end panel sheet portion flexible between a flat unflexed position and a curved flexed position for wrapping around the end of the framework. The method can further include operably coupling a second magnet strip to the first magnet strip, such that the second magnet strip extends outwardly from the first magnet strip beyond the one of said side edges, wherein at least a portion the second magnet strip is operably engageable with the vertical member presented with the framework proximate the end, and wherein a front panel is attachable to at least a portion of a front of the framework, the front panel including a resilient front panel sheet portion and a front panel magnet selectively engageable with at least a portion of the second magnet strip, such that the second magnet strip is in overlapping engagement with the front panel magnet. The second magnet strip can be operably coupled to the first magnet strip with, for example, at least one of double-sided tape, an adhesive, or a combination thereof.

The method of retrofitting above can also, of course, be utilized as a manufacturing method of original parts.

DETAILED DESCRIPTION OF THE DRAWINGS

Figure 1:
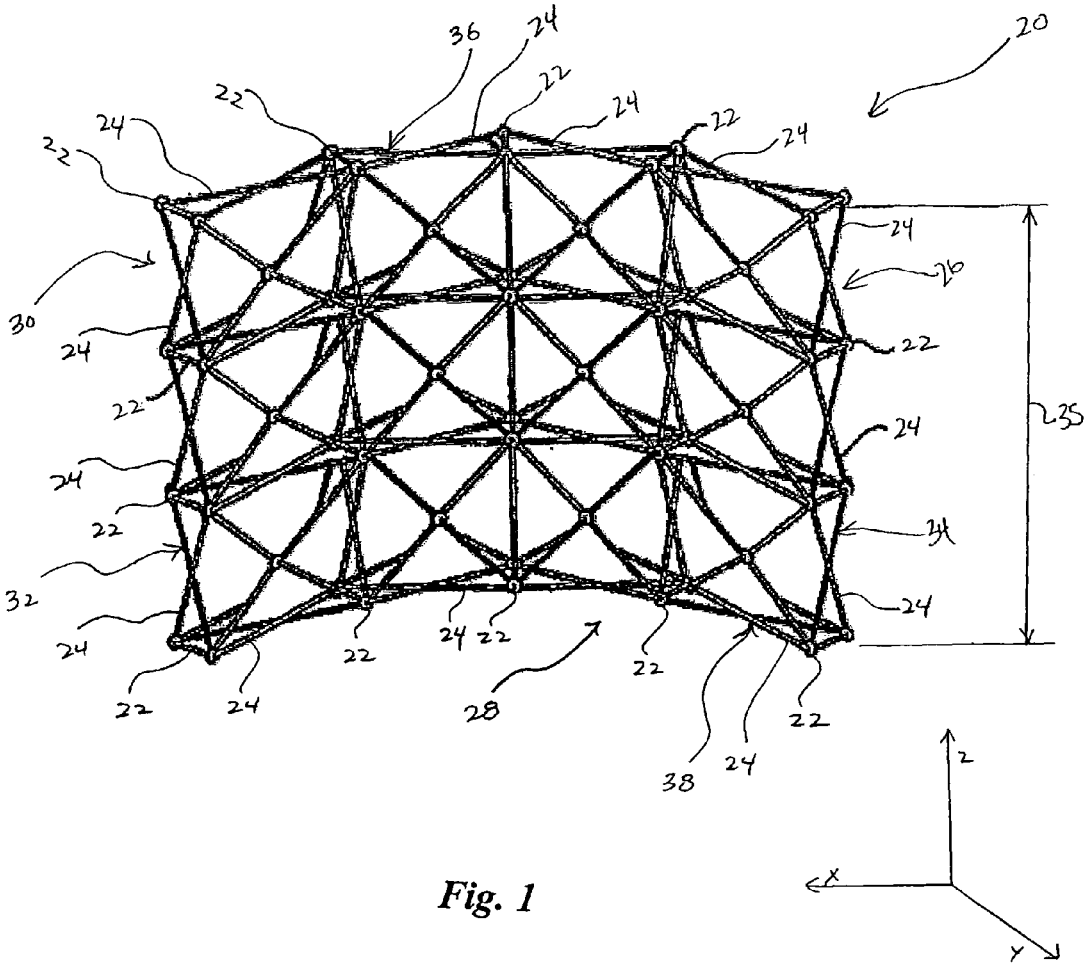
FIG. 1 is a perspective view of a collapsible display framework of a pop-up display.

Referring to FIG. 1, a display 20 for tradeshows and the like generally includes a plurality of hub assemblies 22 and a plurality of support rods 24 therebetween. Support rods 24 can be pivotally attached to hub assemblies 22 to form a foldably collapsible skeletal framework 26. When in an upright, erected configuration as depicted in FIG. 1, framework 26 generally comprises a front face 28, an opposed rear face 30, left and right ends 32, 34, and a height 35.

In a first embodiment, height 35 can be between about 75.0 inches and about 125.0 inches. In this embodiment, height 35 can preferably be between about 80.0 inches and about 120.0 inches and optimally be between about 90.0 inch and about 100.0 inches. In another embodiment, height 35 can be between about 50.0 inches and about 100.0 inches. In this embodiment, height 35 can preferably be between about 60.0 inches and about 90.0 inches and optimally be between about 70.0 inch and about 80.0 inches. While height 35 has been described as being between about 50.0 inches and about 125.0 inches, those skilled in the art will recognize that other dimensions less than about 50.0 inches and above about 125.0 inches can be used. For example, in an embodiment of display 20 configured for placement on a tabletop, height 35 can be less than about 50.0 inches. Further, a person of ordinary skill in the art will also recognize that additional ranges within the explicit ranges given above are contemplated and are within the present disclosure.

Framework 26 further comprises a top 36 and a generally opposed bottom or base 38. Various embodiments of framework 26 are further described in U.S. Pat. Nos. 5,203,126, 5,203,134, and 6,829,869, which are incorporated herein by reference in their entirety.

Figure 2:
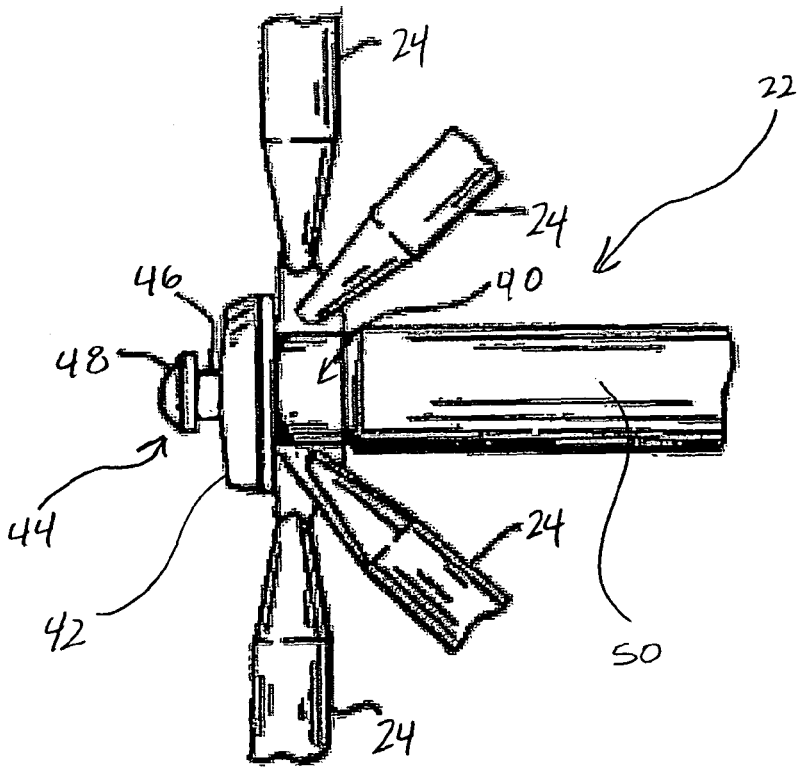
FIG. 2 is a side elevational view of a hub assembly of the framework of FIG. 1.

Referring to FIG. 2, each hub assembly 22 of collapsible display 20 comprises one or more hubs 40, each hub having an outer face 42 with a centrally located and outwardly projecting fastening button 44 thereon. Button 44 includes a shaft or shank 46 and an enlarged head 48 presented thereon. Each hub assembly can further include a post 50 extending between the one or more hubs 40 of hub assembly 22 for further support and for ease of assembly and collapsing.

Figure 3:
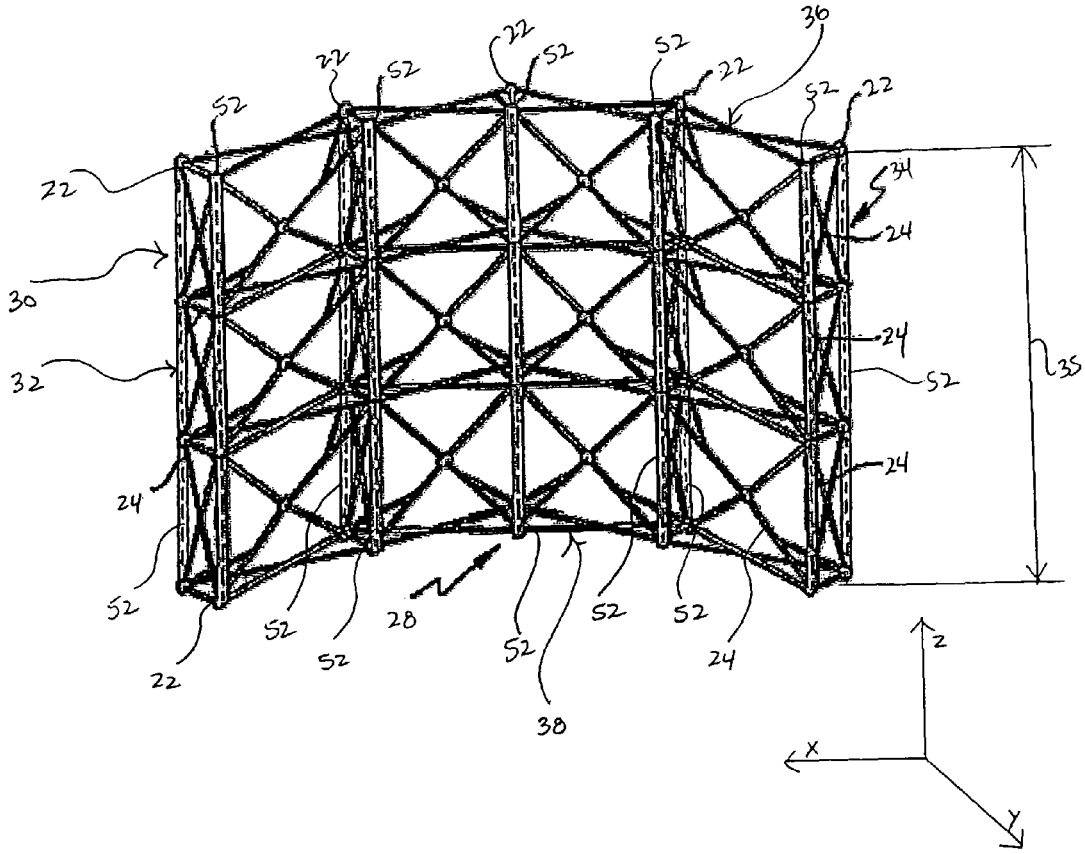
FIG. 3 is a perspective view of the framework of FIG. 1, depicting a plurality of elongate members attached to the framework forming vertical columns thereon.
Figure 4:
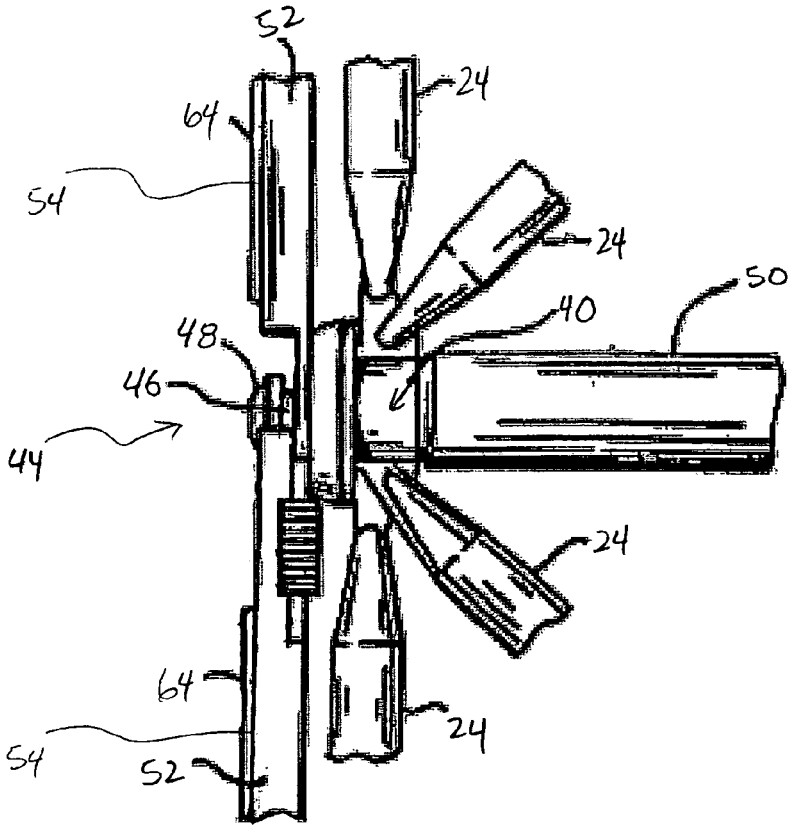
FIG. 4 is a side elevational view of a hub assembly of the display framework of FIG. 2 depicting the support elongate members attached to a fastening button of the hub assembly.

Referring to FIGS. 3 and 4, collapsible display structure 20 further includes a plurality of elongate members or elongate members 52 attached to the framework 26 forming vertical columns for supporting framework 26 and/or for attachment of covering material to framework 26. Elongate members 52 can be attached on the front and rear faces 28, 30 and proximate the left and right ends 32, 34 of the display structure 20 and extend vertically between the fastening buttons hubs 44 of vertically adjacent hub assemblies 22 substantially the height 35 of the erected framework 26. Elongate members 52 can be used as vertical columns to support the framework 26 in an upright, open configuration. Elongate members 52 can also be used to support panels on the front and rear faces 28, 30 and on the left and right ends 32, 34 of the display structure 20 (panels described in greater detail herein). Elongate members 52 can further be used to support shelves or other storage or display structures on the on the front and rear faces 28, 30 and on the left and right ends 32, 34 of the display structure 20.

Figure 5:
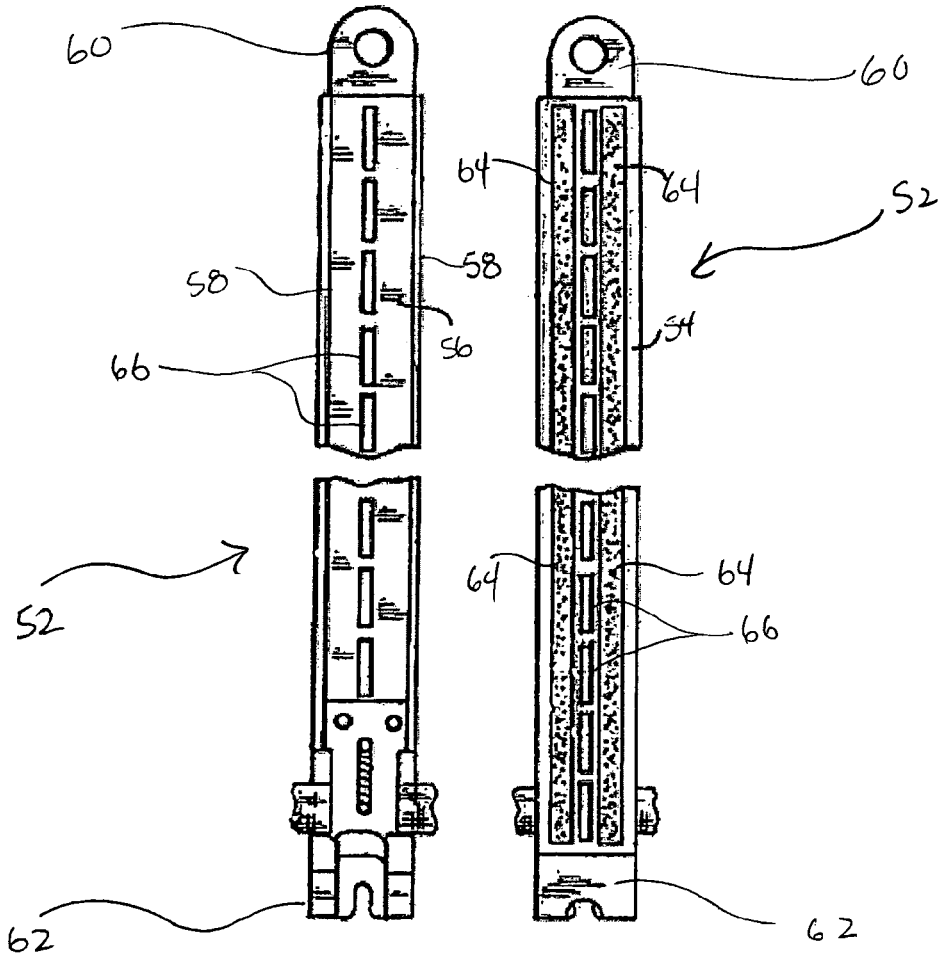
FIG. 5*a* is a fragmentary elevational view of the elongate member of FIG. 3.
FIG. 5B is a fragmentary elevational view of the elongate member of FIG. 3.

Referring to FIGS. 5*a* and 5*b*, elongate member 52 comprises a front face 54, back face 56, stiffening side members 58 for further structural support, and a pair of generally opposed ends 60, 62. Elongate members 52 can further include one or more flexible magnetized strips 64 adhered or otherwise coupled with the front face 54 thereof. In addition, slots 66 can be included along any portion or the length of elongate member 52. Slots 66 can be adapted to receive the engaging hooks or other structures of commonly used or commercially available adjustable shelf brackets. Elongate members 52 according to some embodiments are further described in U.S. Pat. No. 6,829,869, which is incorporated herein by reference in its entirety.

Figure 6:
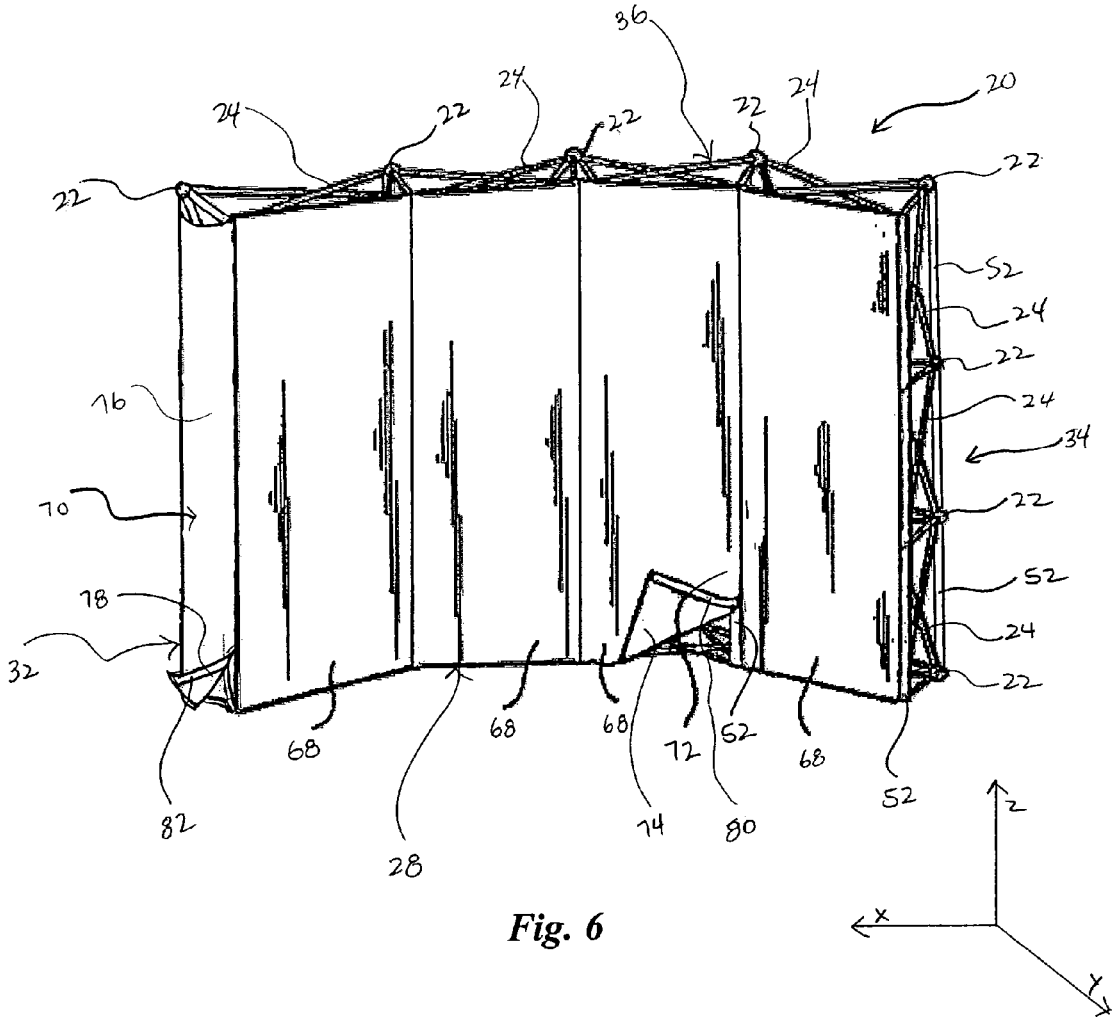
FIG. 6 is a perspective view of the framework of FIG. 3, depicting a panel set attached to the elongate members, including a curved end panel at an end of the framework.

Referring to FIG. 6, collapsible display structure 10 can further include a plurality of face panels 68 and end panels 70 coupled to framework 26, such as to elongate members 52. The face panel 68 comprises a front surface 72 and a rear surface 74, the front surface 72 being configured to include graphics thereon. The end panel 70 comprises an outer surface 76 and an inner surface 78, the outer surface 76 being configured to include graphics thereon. The face panels 68 and end panels 70 can be laminated polycarbonate/paper laminate sheets, or can be a fabric or carpet material. The graphics can be included on the face panels 68 and end panels 70 by printing the graphics on a graphics sheet that is then laminated between two sheets of polycarbonate (e.g., the panels 68, 70 comprise a back sheet and a front sheet of polycarbonate that sandwich the graphics sheet therebetween.)

Figure 7A:
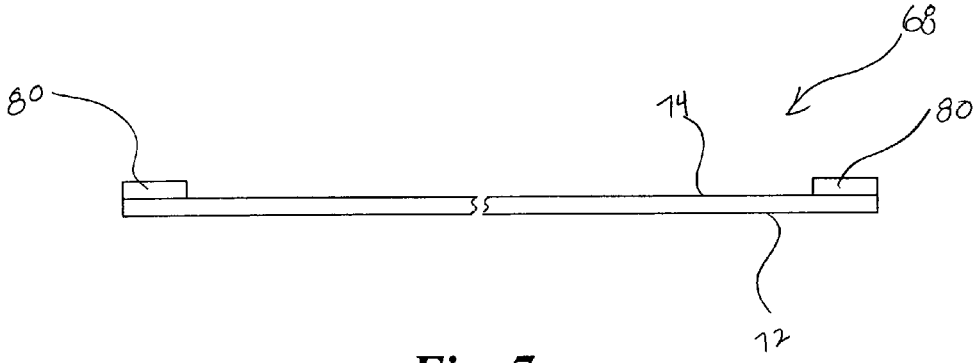
FIG. 7*a* is a fragmentary top plan view of a face panel including face panel magnets thereon.

A face panel 68 is further depicted in FIG. 7*a*. The face panels 68 can include one or more flexible face panel magnetized strips 80 attached to the back side 74 thereof and proximate the ends there of for coupling the face panels 68 with the elongate members 52 once the elongate members 52 are attached to the framework 26. As depicted in the figures, face panel magnets 80 can be elongate and can comprise a generally thin rectangular cross section. The face panel magnets 80 can be attached to the face panels 68 along a length thereof using double sided tape, such as a thin polyester film carrier coated on both sides with a rubber-based, pressure-sensitive adhesive, an adhesive, or other coupling mechanisms known to those skilled in the art.

Figure 7B:
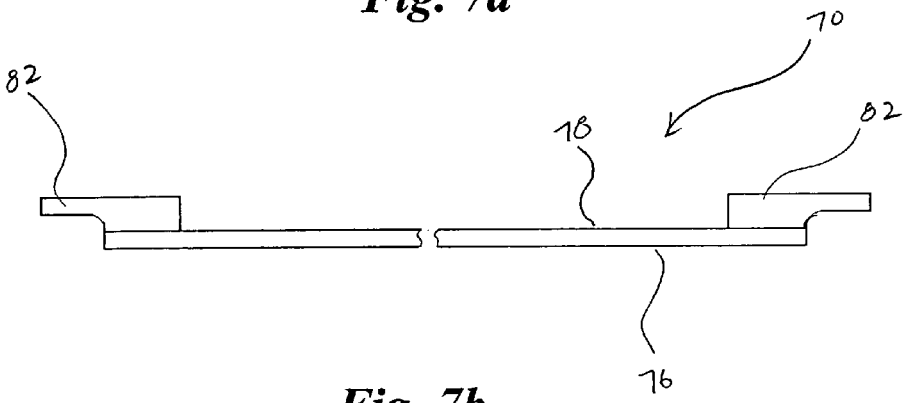
FIG. 7*b* is a fragmentary top plan view of an end panel including end panel magnets according to an embodiment.

An end panel 70 is further depicted in FIG. 7*b*. End panel 70 is flexible between a flat position and a curved position for wrapping around one of the ends 32, 34 of the framework 26. The end panels 70 include one or more end panel magnets 82 attached to the back side 78 thereof for coupling the end panel 70 with the elongate members 52 proximate the left and right ends 32, 34 of the framework 26 once the elongate members 52 are attached to the framework 26. The end panel magnets 82 can be attached to the end panels 70 along a length thereof using double sided tape, such as a thin polyester film carrier coated on both sides with a rubber-based, pressure-sensitive adhesive, an adhesive, or other coupling mechanisms known to those skilled in the art.

Figure 8:
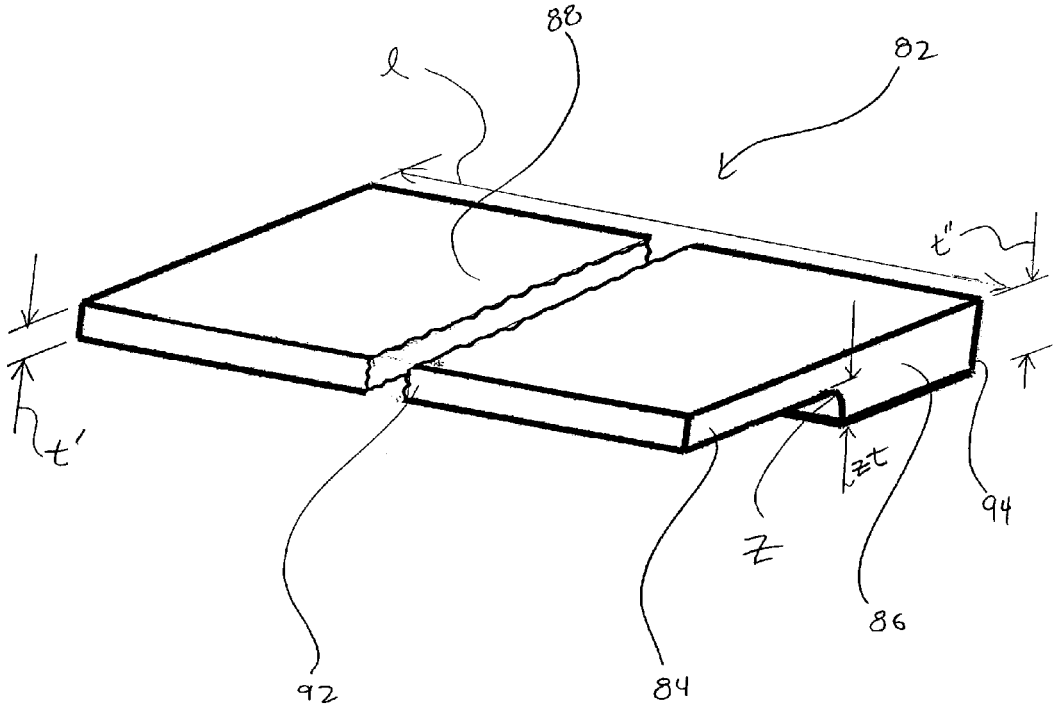
FIG. 8 is a perspective view of the end panel magnet of FIG. 7*b;*
Figure 9:
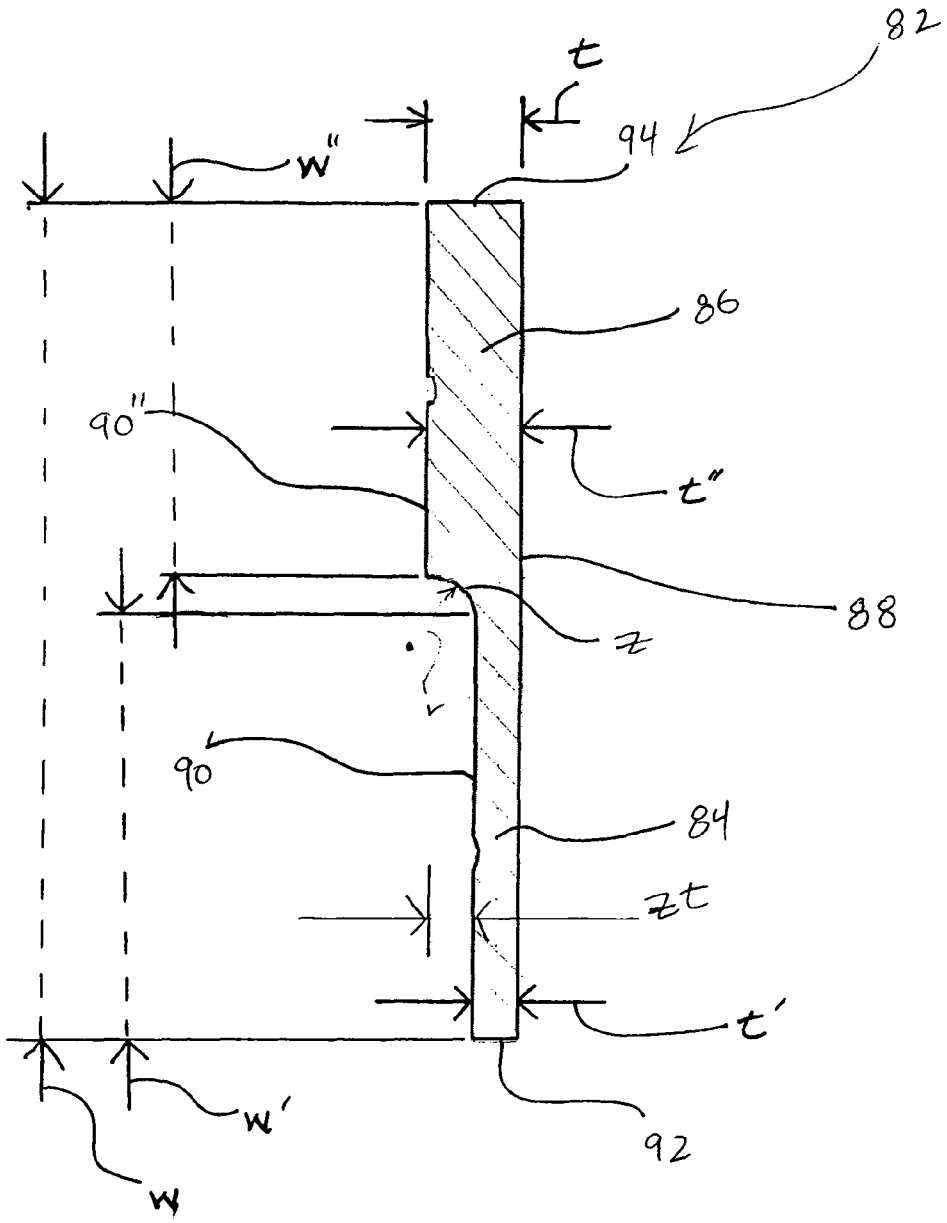
FIG. 9 is a cross-sectional view of the end panel magnet of FIG. 7*b;*

Referring to FIGS. 8 and 9, end panel magnet 82 comprises a stepped rectangular or multiple-thickness, cross section having a first portion 84 and a second portion 86, second portion 86 having a thicker cross section than first portion 84. End panel magnet 82 comprises a length l that can be substantially the same as height 85. For example, in embodiments in which height 35 is be between about 75.0 inches and about 125.0 inches, length l can be between about 75.0 inches and about 125.0 inches. In this embodiment, length l can preferably be between about 80.0 inches and about 120.0 inches and optimally be between about 90.0 inch and about 100.0 inches. In another embodiment, length l can be between about 50.0 inches and about 100.0 inches. In this embodiment, length l can preferably be between about 60.0 inches and about 90.0 inches and optimally be between about 70.0 inch and about 80.0 inches. While length l has been described as being between about 50.0 inches and about 125.0 inches, those skilled in the art will recognize that other dimensions less than about 50.0 inches and above about 125.0 inches can be used. For example, in an embodiment of display 20 configured for placement on a tabletop, length l can be less than about 50.0 inches. Further, a person of ordinary skill in the art will also recognize that additional ranges within the explicit ranges given above are contemplated and are within the present disclosure.

Referring to FIG. 9, which depicts a cross section of end panel magnet 82, end panel magnet 82 comprises a width w and a thickness t. Thickness t comprises a first thickness t' (corresponding with first portion 84) and a second thickness t" (corresponding with second portion 86), the second thickness t" being greater than the first thickness t'. The width w comprises a first width w' and a second width w", the first width w' corresponding to the first thickness t' and the second width w" corresponding to the second thickness t". A transition zone z comprising a radius r can be included intermediate the first and second width w', w" to inhibit any cracking or breakage proximate the area between the first and second thicknesses t', t". In other embodiments, transition zone z can comprise a step and not be radiused.

Width w can be between about 0.500 inch and about 4.000 inches. Preferably, width w can be between about 1.000 inch and about 2.000 inches. Optimally, width w can be between about 1.000 inch and about 1.500 inches. While width w has been described as being between about 0.500 inch and about 4.000 inches, those skilled in the art will recognize that other dimensions less than about 0.500 inch and above about 4.000 inches can be used. Further, a person of ordinary skill in the art will also recognize that additional ranges within the explicit ranges given above are contemplated and are within the present disclosure.

First thickness t' can be between about 0.001 inch and about 0.250 inch. Preferably, first thickness t' can be between about 0.025 inch and about 0.125 inch. Optimally, first thickness t' can be between about 0.050 inch and about 0.100 inch. While first thickness t' has been described as being between about 0.001 inch and about 0.250 inch, those skilled in the art will recognize that other dimensions less than about 0.001 inch and above about 0.250 inch can be used. Further, a person of ordinary skill in the art will also recognize that additional ranges within the explicit ranges given above are contemplated and are within the present disclosure.

Second thickness t" can be between about 0.001 inch and about 0.500 inch. Preferably, second thickness t" can be between about 0.050 inch and about 0.250 inch. Optimally, second thickness t" can be between about 0.100 inch and about 0.150 inch. While second thickness t" has been described as being between about 0.001 inch and about 0.500 inch, those skilled in the art will recognize that other dimensions less than about 0.001 inch and above about 0.500 inch can be used. Further, a person of ordinary skill in the art will also recognize that additional ranges within the explicit ranges given above are contemplated and are within the present disclosure.

Referring again to FIGS. 8 and 9, end panel magnet 82 comprises a generally planar inner surface 88, a generally opposed an outer surface 90, and a first and second ends 92, 94. The outer surface comprises first and second generally planar surface portions 90', 90" generally corresponding with the first and second portions 84, 86 of the end panel magnet 82, respectively.

Figure 10:
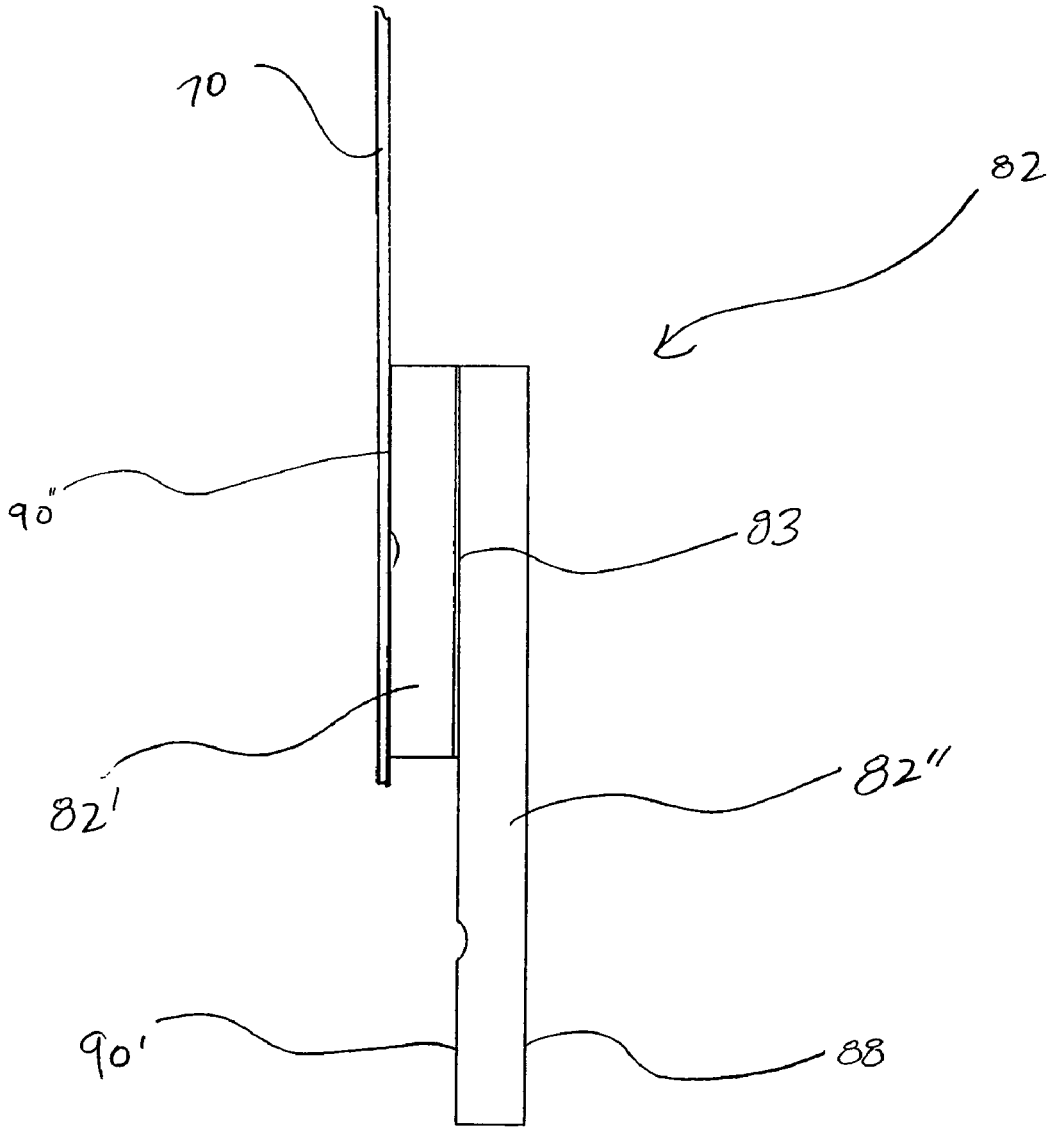
FIG. 10 is a cross-sectional view of the end panel magnet according to a second embodiment.
Figure 14:
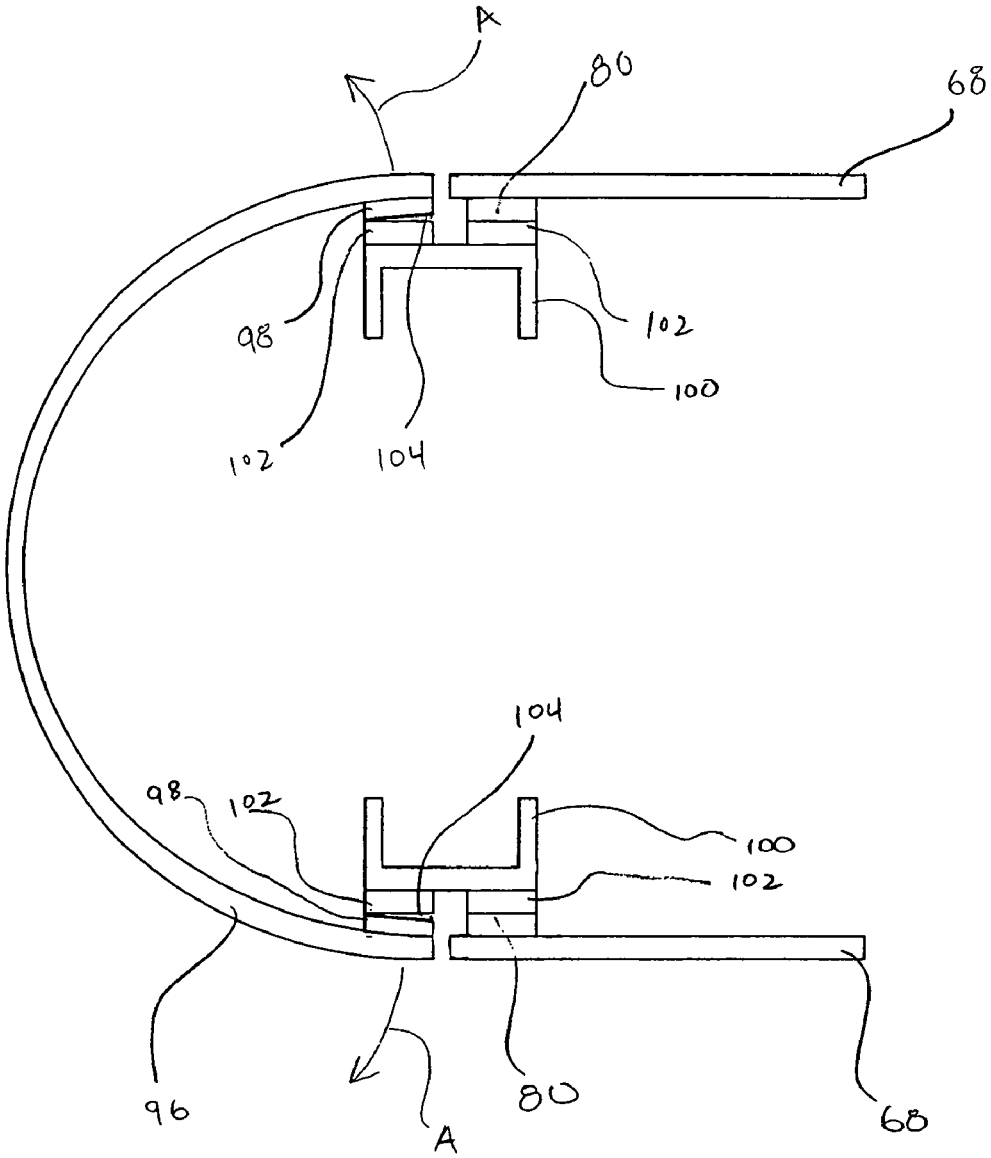
Fig.14 Prior Art
FIG. 14 is a top plan view of an end panel not having an end panel magnet of configuration of this invention, depicting decoupling between the end panel magnet and elongate member.

The end panel magnet can be extruded in a unitary, one-piece stepped form, such as depicted in FIGS. 8 and 9. Referring to FIG. 10, in another embodiment, end panel magnet 82 can be built-up using a first, generally rectangular narrower strip 82' bonded and/or attached to a second, generally rectangular wider strip 82". A layer of adhesive 83, double-sided tape, or the like can be used to attach strip 82' to strip 82". The end panel magnet 82 according to the embodiment as depicted in FIG. 10 can be used, in addition to an original manufactured configuration for retrofitting existing end panel magnets, such as those depicted in FIG. 14. For example, a method of retrofitting an end panel 70 for concealing an end 32 of collapsible tradeshow display framework 26 can comprise operably coupling the first magnet strip 82' already attached to end panel 70 to the second magnet strip 82", such that the second magnet strip 82" extends outwardly from the first magnet strip 82' beyond an edge of end panel 70.

Figures 11A, 11B:
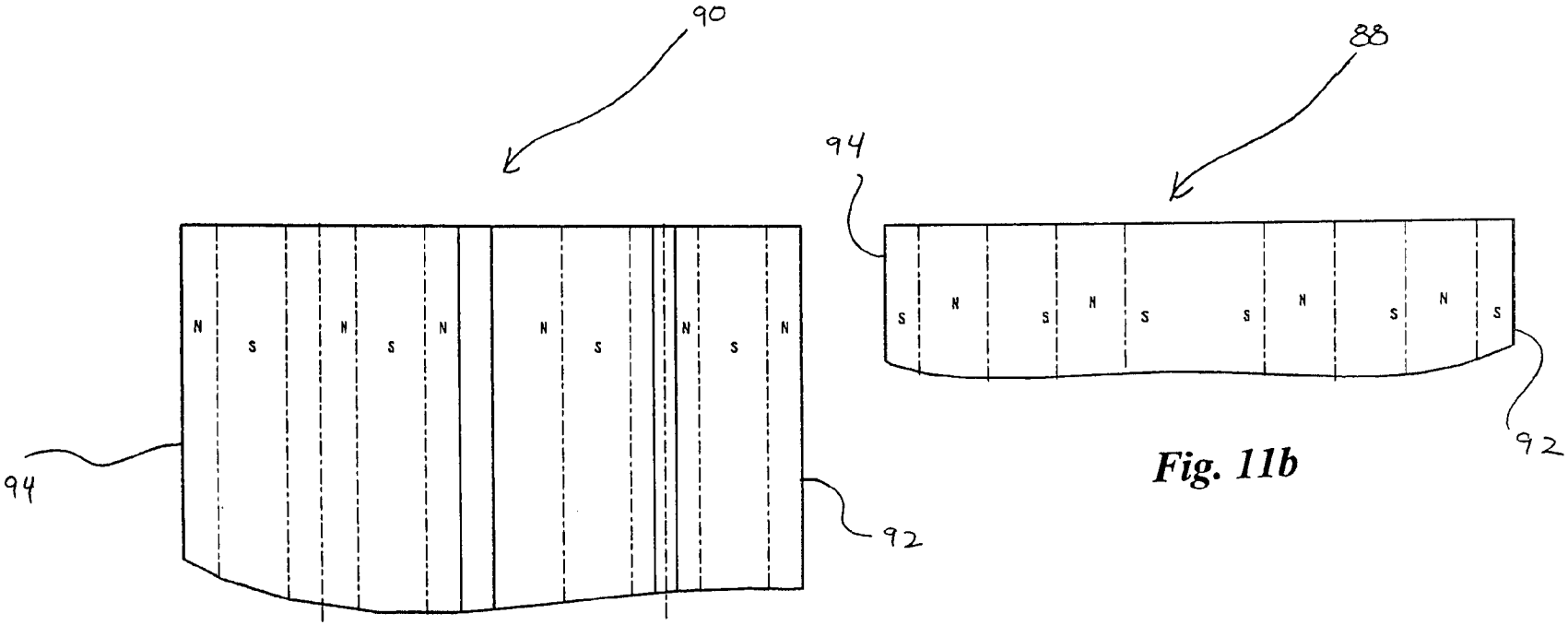
FIG. 11*a* is a schematic view of a stepped side of an end panel magnet depicting alternating polarity magnetized zones.
FIG. 11*b* is a schematic view of a flat side of an end panel magnet depicting alternating polarity magnetized zones.
Figure 12A:
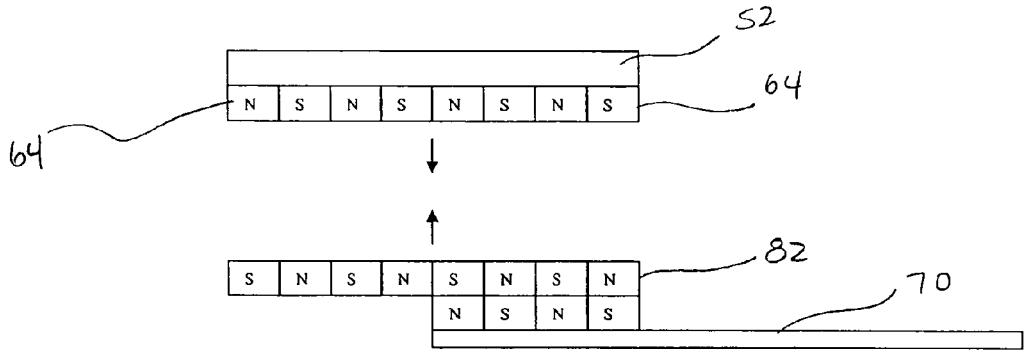
FIG. 12*a* is a schematic view of an end panel magnet and elongate member magnet, depicting alternating polarity magnetized zones on each, prior to coupling between the magnets.
Figure 12B:
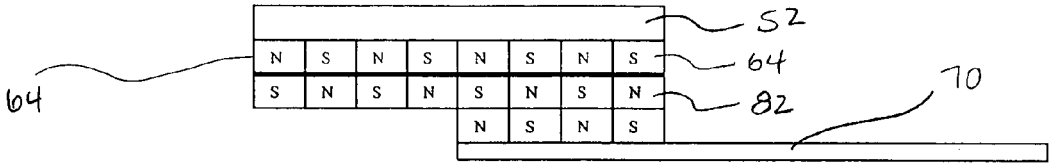
FIG. 12*b* is a schematic view of an end panel magnet and elongate member magnet, depicting alternating polarity magnetized zones on each, after the coupling between the magnets.

Referring to FIGS. 11*a* and 11*b*, end panel magnet 82 can be magnetized in bands across its width (N=North, S=South). End panel magnet 82 can be magnetized on both the inner surface 88 and generally opposed outer surface 90. Referring to FIGS. 12*a* and 12*b*, when used in combination with flexible magnetized strips 64 on elongate members 52, which also can comprise magnetized bands across a width, the end panel magnet 82 and magnetized strips 64 can register or orient themselves with respect to one another, which inhibits the potential for mismatched edges. Specifically, because "N" magnetized bands on magnetized strips 64 on elongate members 52 generally repel "N" magnetized bands on end panel magnet 82 (and likewise for "S" magnetized bands), the end panel magnet 82 and magnetized strips 64 are inhibited from sliding or moving with respect to one another once coupled.

Figure 12C:
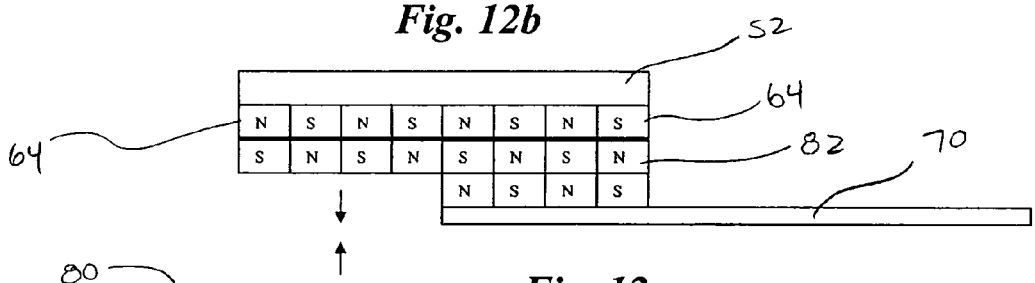
FIG. 12*c* is a schematic view of an end panel magnet, face panel magnet, and elongate member, depicting alternating polarity magnetized zones on the end panel magnet and face panel magnet, prior to coupling.
Figure 12D:
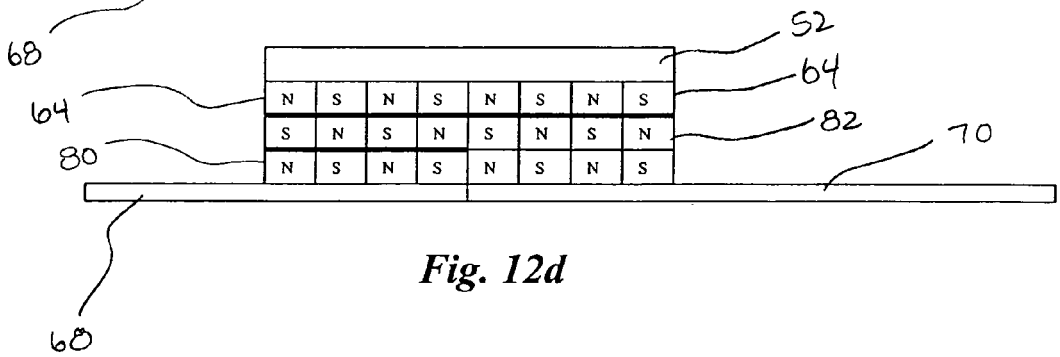
FIG. 12*d* is a schematic view of an end panel magnet, face panel magnet, and elongate member, depicting alternating polarity magnetized zones on the end panel magnet and face panel magnet, after coupling.

Referring to FIGS. 12*c* and 12*d*, when used in combination with face panel magnets 80, which also can comprise magnetized bands across a width, the end panel magnet 82 and face panel magnets 80 can register or orient themselves with respect to one another, which inhibits the potential for mismatched edges on panels 68, 70. Specifically, because "N" magnetized bands on face panel magnets 80 generally repel "N" magnetized bands on end panel magnet 82 (and likewise for "S" magnetized bands), the end panel magnet 82 and face panel magnets 80 are inhibited from sliding or moving with respect to one another once coupled.

Figure 13:
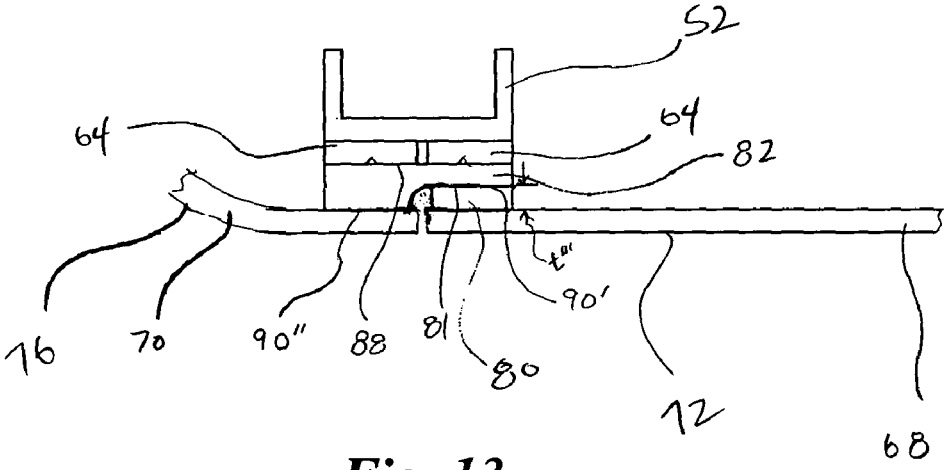
FIG. 13 is a top plan view of the coupling between the end panel magnet, face panel magnet, and elongate member according to a first embodiment.

Referring to FIG. 13, the coupling between the end panel 70, face panel 68, and elongate member 52 according to a first embodiment is depicted. Inner surface 88 of the end panel magnet 82 is coupled with at least a portion of magnetized strips 64 on the elongate member 52. In an embodiment in which height 85 is about 93.75 inches and end panel magnet 82 is substantially the same as height 85, and width w of end panel magnet 82 is about 1.125 inches, the surface area of the coupling between the end panel magnet 82 and magnetized strips 64 is between about 100.00 square inches and about 110.00 square inches. In an embodiment in which height 85 is about 77.00 inches and end panel magnet 82 is substantially the same as height 85, and width w of end panel magnet 82 is about 1.125 inches, the surface area of the coupling between the end panel magnet 82 and magnetized strips 64 is between about 80.00 square inches and about 90.00 square inches. A person of ordinary skill in the art will also recognize that additional ranges within the explicit ranges given above are contemplated and are within the present disclosure.

Inner surface 81 of the face panel magnet 80 is coupled with outer surface 90' of end panel magnet 82. In this configuration, end panel magnet 82 is operably sandwiched intermediate the elongate member 52 and the face panel magnet 80, or such that the such that the end panel magnet 82 is in overlapping engagement with the face panel magnet 80. In an embodiment in which height 85 is about 93.75 inches and face panel magnet 80 and end panel magnet 82 are substantially the same as height 85, and width w' of end panel magnet 82 and also width of face panel magnet 80 are each about 0.50 inches, the surface area of the coupling between the end panel magnet 82 and face panel magnet 80 is between about 40.00 square inches and about 50.00 square inches. In an embodiment in which height 85 is about 77.00 inches and length l of end panel magnet 82 is substantially the same length as height 85, and width w' of end panel magnet 82 and also width of face panel magnet 80 are each about 0.50 inches, the surface area of the coupling between the end panel magnet 82 and magnetized strips 64 is between about 30.00 square inches and about 40.00 square inches. A person of ordinary skill in the art will also recognize that additional ranges within the explicit ranges given above are contemplated and are within the present disclosure.

When the end panel magnet 82 is operably sandwiched intermediate the elongate member 52 and the face panel magnet 80, the end panel 70 can strongly couple to the elongate member 52. Specifically, once the end panels 70 are curved and placed upon the elongate member 52, the end panel magnet 82 being operably sandwiched intermediate the elongate member 52 and the face panel magnet 80 can inhibit or prevent the end panel 70 from returning to its original, flat configuration when bumped, hit, or otherwise deflected. For example, if someone walks by the display 20 and incidentally bumps the end panel 70, the force of the bump will not decouple the end panel magnet 80 from the elongate member 52 or elongate member magnet(s) 64.

In an embodiment, the elongate member 52 comprises an elongate member width, wherein the end panel magnet 80 is selectively engageable across substantially the entire elongate member width. This can further inhibit or prevent the end panel 70 from returning to its original, flat configuration when bumped, hit, or otherwise deflected.

Further, when in the configuration as depicted in FIG. 13, the front surface 72 of the face panel 68 and the outer surface of the end panel 70 are substantially flush, providing a continuous, pleasing appearance to the collapsible display structure 20. Specifically, referring to FIG. 9, the end panel magnet 82 comprises first and second portions 84, 86 separated by a transition zone z, the second portion 86 being thicker than the first portion 84 by a transition thickness "zt".

Transition thickness "zt" can be between about 0.001 inch and about 0.250 inch. Preferably, transition thickness "zt" can be between about 0.025 inch and about 0.125 inch. Optimally, transition thickness "zt" can be between about 0.050 inch and about 0.100 inch. While transition thickness "zt" has been described as being between about 0.001 inch and about 0.250 inch, those skilled in the art will recognize that other dimensions less than about 0.001 inch and above about 0.250 inch can be used. Further, a person of ordinary skill in the art will also recognize that additional ranges within the explicit ranges given above are contemplated and are within the present disclosure.

Figure 15:
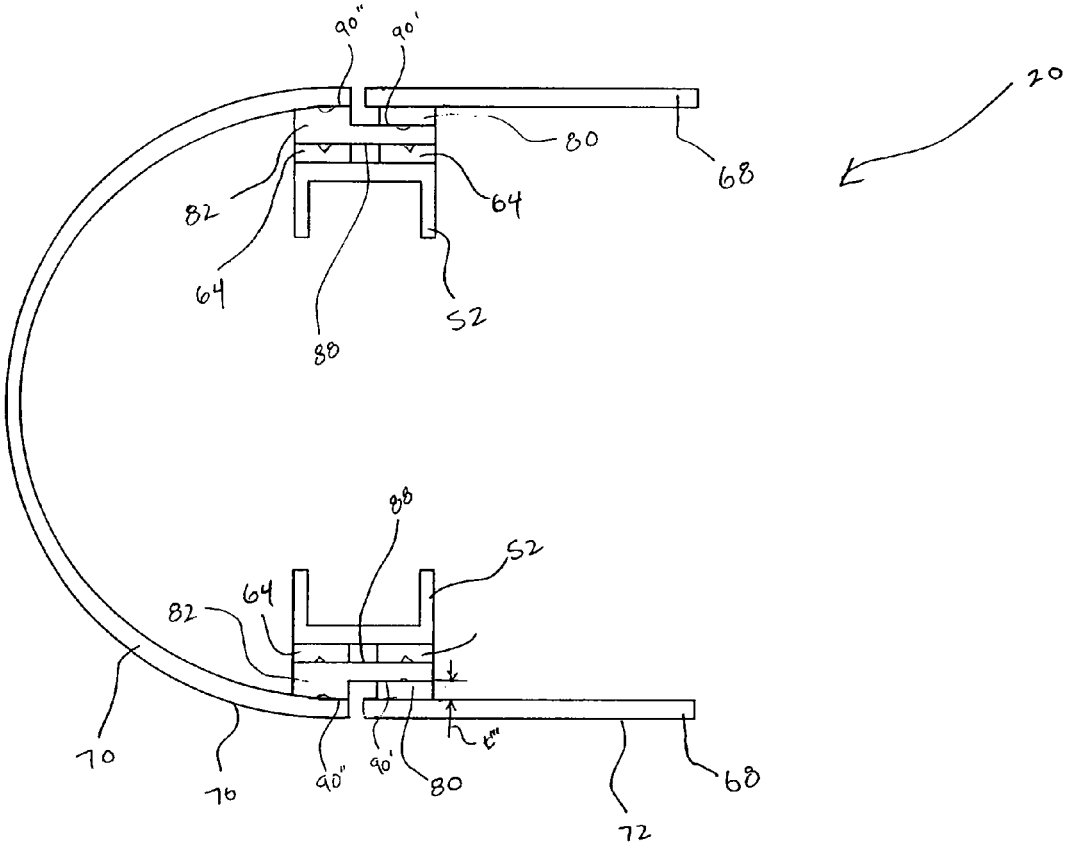
FIG. 15 is a top plan view of an end panel having an end panel magnet depicting the maintained coupling between the end panel magnet, face panel magnet, and elongate member.
Figure 16:
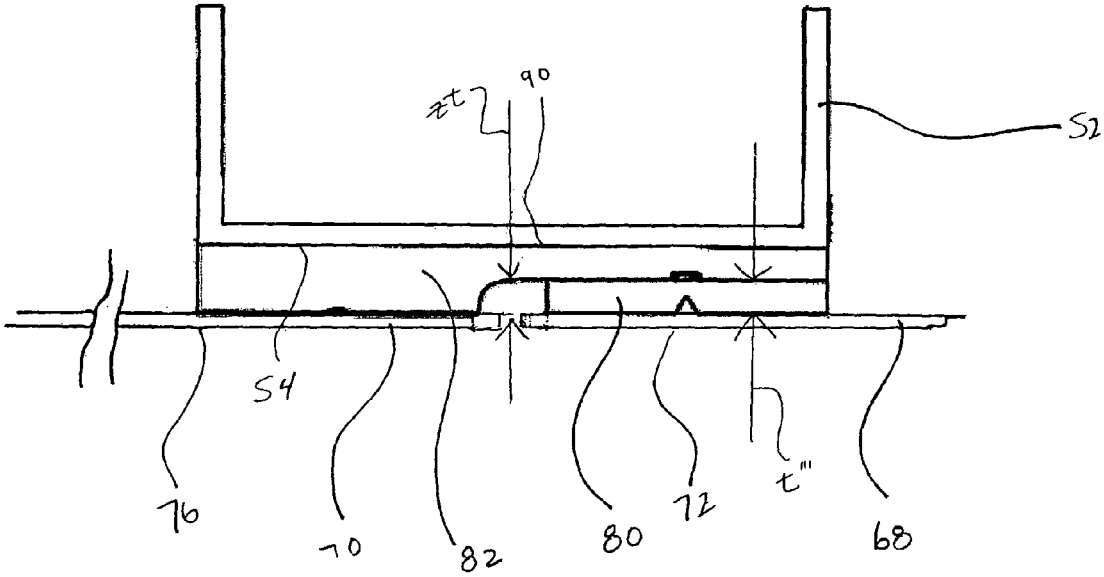
FIG. 16 is a close-up top plan view of the coupling between the end panel magnet, face panel magnet, and elongate member according to a second embodiment.

Referring to FIGS. 13, 15, and 16, the end panel 70 comprises an outer surface 76 and the front panel 68 comprises a front surface 72, the front panel magnet 80 comprising a front panel magnet thickness t''' that can be substantially the same as the transition thickness "zt", such that when the end panel magnet 82 is engaged with the elongate member 52 and the front panel magnet 80 is engaged with the end panel magnet 82, the outer surface 76 of the end panel 70 and the front surface 72 of the front panel 68 are substantially flush. Specifically, front panel magnet thickness t''' can be between about 0.001 inch and about 0.250 inch. Preferably, front panel magnet thickness t''' can be between about 0.025 inch and about 0.125 inch. Optimally, front panel magnet thickness t''' can be between about 0.050 inch and about 0.100 inch. While front panel magnet thickness t''' has been described as being between about 0.001 inch and about 0.250 inch, those skilled in the art will recognize that other dimensions less than about 0.001 inch and above about 0.250 inch can be used. Further, a person of ordinary skill in the art will also recognize that additional ranges within the explicit ranges given above are contemplated and are within the present disclosure.

As described above, and in reference to FIG. 14, in systems having end panels 96 having end panel magnets 98 thereon having a width of (or less than) the half of the width of the elongate member 100, such as corresponding with only one of two magnetized strips 102 included on elongate member 100, as depicted, end panels 96 can be decoupled from magnetized strips 102 that are included on the elongate members 100 due to the relatively small amount of magnet to magnet surface contact between the end panel magnet 98 and magnetized strip 102 included on the elongate member 100. Because the end panel 96 can have some rigidity, it can desire to return to a flat, uncurved configuration. This can create a lever action on the magnet 98, causing a portion of the magnet 98 to lift off of the magnetized strip 102 creating a gap 104 in a magnetic coupling region. Once this occurs, the magnetic force remaining can be less than that needed to retain the coupling between the end panel magnet 98 and the magnetized strip 102, thus causing the end panel 96 to decouple from elongate member 100.

On the other hand, in the first embodiment, as depicted in FIG. 15, inner surface 88 of end panel magnet 82 comprises a width sufficient to retain the coupling between end panel 70 and elongate member 52, even when the end panel is bumped, hit, or otherwise deflected. For example, as depicted in FIG. 15, inner surface 88 of end panel magnet 82 is coupled with both of magnetized strips 64 included on elongate member 52. Because of the large magnet to magnet contact surface area, there is a large magnetic force holding end panel magnet 82, and thus end panel 70, in coupling relationship with the elongate member 52 despite the tendency of end panel 70 to flatten out and despite any forces that might be incident upon end panel 70 coupled to elongate member 52.

Further, the stepped (dual thickness) configuration of end panel magnet 82 enables the above strong coupling, while further providing structure such that the end and face panels 70, 68 are in flush relationship when coupled with elongate member 52. Referring to FIG. 15, outer surfaces 72, 76 of face and end panels 68, 70, respectively, are substantially flush, providing a continuous, pleasing appearance to collapsible display structure 20.

Referring to FIG. 16, in a second embodiment, elongate member 52 does not include any magnetized strips thereon. In this embodiment, inner surface 90 of end panel magnet 82 directly couples with front face 54 of elongate member 52. The magnet-to-elongate member contact surface area is sufficient to hold end panel magnet 82, and thus end panel 70, in coupling relationship with elongate member 52 despite the tendency of end panel 70 to flatten out and despite any forces that might be incident upon end panel 70 with coupled to the elongate members.

Figure 17:
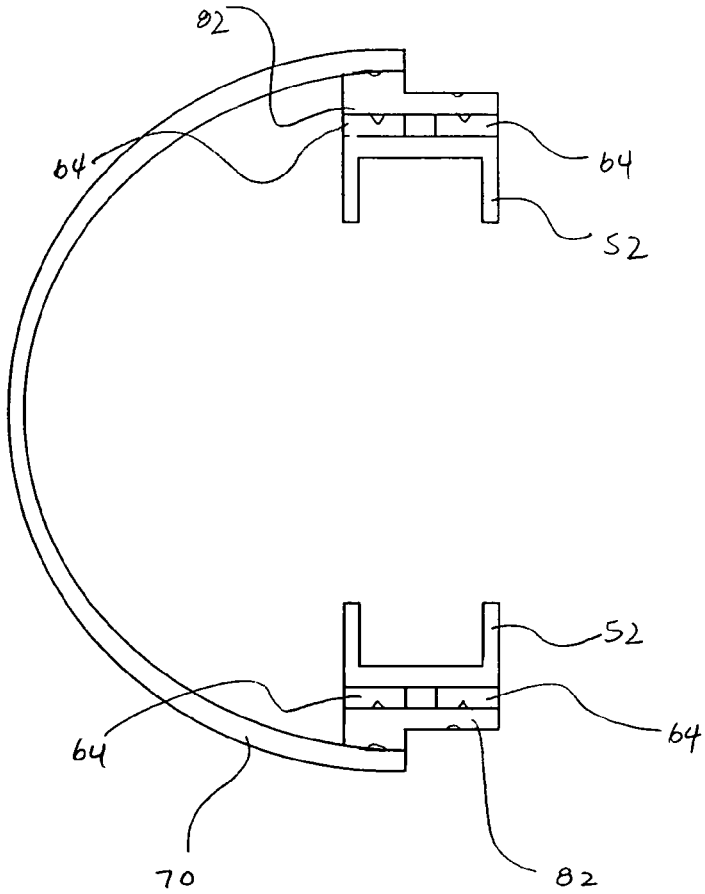
FIG. 17 is a top plan view of the end panel of FIG. 12 prior to engaging the face panel magnet with the end panel magnet.

In operation, once the framework 26 is placed on a desired surface, such as the floor or a tabletop, and the framework 26 expanded to an open configuration (FIG. 1), multiple elongate members 52 can be successively attached to support structure 26 to form vertical column arrangements providing vertical support to display structure 26 (FIG. 3). Next, referring to FIG. 17, end panels 70 can be placed on the framework 26 by magnetically engaging end panel magnets 82 with magnetized strips 64 on elongate members 52. Because of the strong coupling between end panel magnets 82 and elongate member magnets 64, this can be done for both end panel magnets 82 on end panel 70 at the same time. Alternatively, a first end panel magnet 82 can be magnetically engaged with magnetized strip 64 on elongate member 52 before a second magnet 82 is magnetically engaged with magnetized strip 64.

Figure 18:
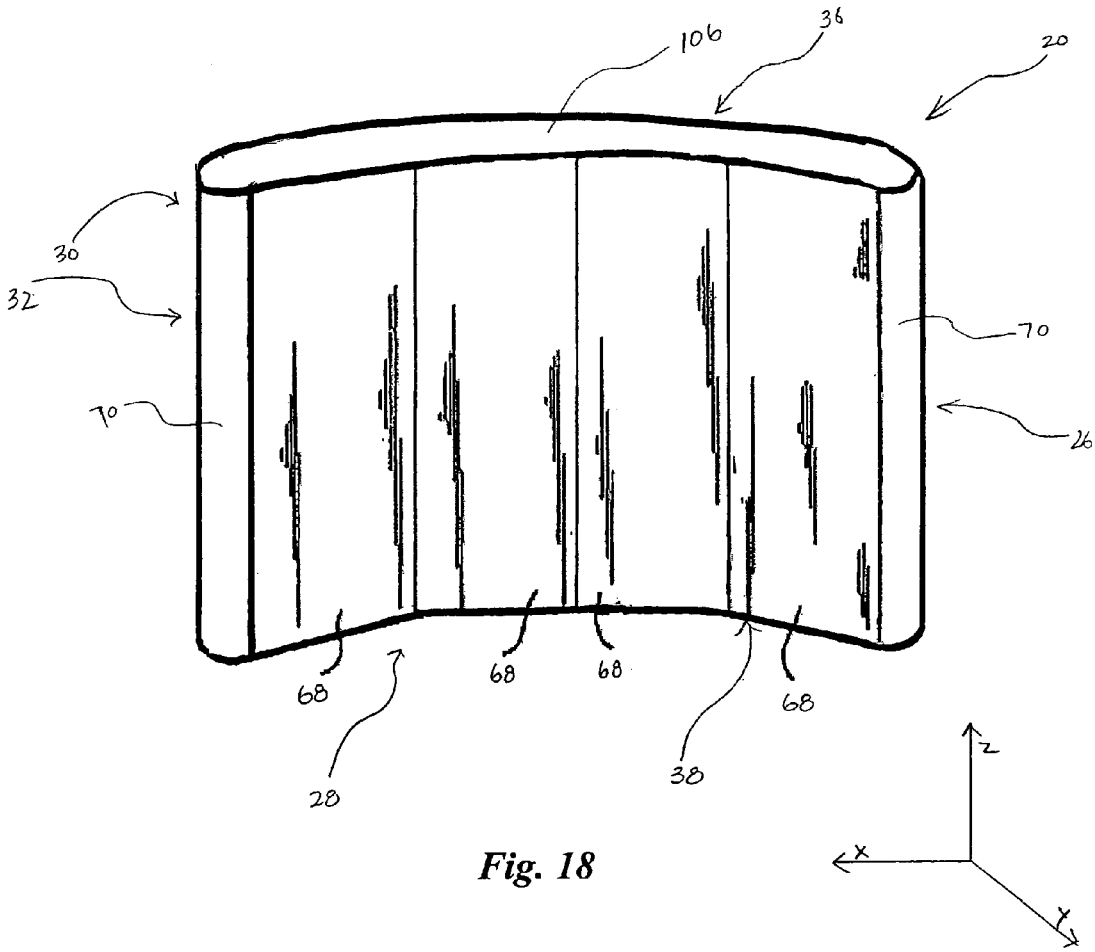
FIG. 18 is a perspective view of the framework of FIG. 2, depicting a panel set attached to the elongate members, including a curved end panel at an end of the framework.

Referring again to FIG. 15, once end panel 70 is positioned on elongate members 52, one or more face panels 68 adjacent end panel 70 can be placed on elongate members 52. To do so, face panel magnets 80 proximate end panels 70 can be magnetically engaged with outer surface 90 of end panel magnets 82, such that outer surfaces 72, 76 of face and end panels 68, 70, respectively, are substantially flush. Further face panels 68 can be added to the structure 26 until a user is satisfied that the display 20 has the desired visual appeal. For example, when back 30 of display 20 is against a wall or other structure, face panels 68 can be selectively applied to the front 28 of display 20 up to end panels 70, leaving the back 30 of the structure 26 exposed. When the display 20 is in the middle of a room or in a place that the back 30 of the structure 26 might be otherwise exposed, further face panels 68 can be placed on the rear 30 of the structure 26. A display 20 having panels completely around a perimeter thereof, and a top panel 106 on the top of display 20, is depicted in FIG. 18.

Figure 19:
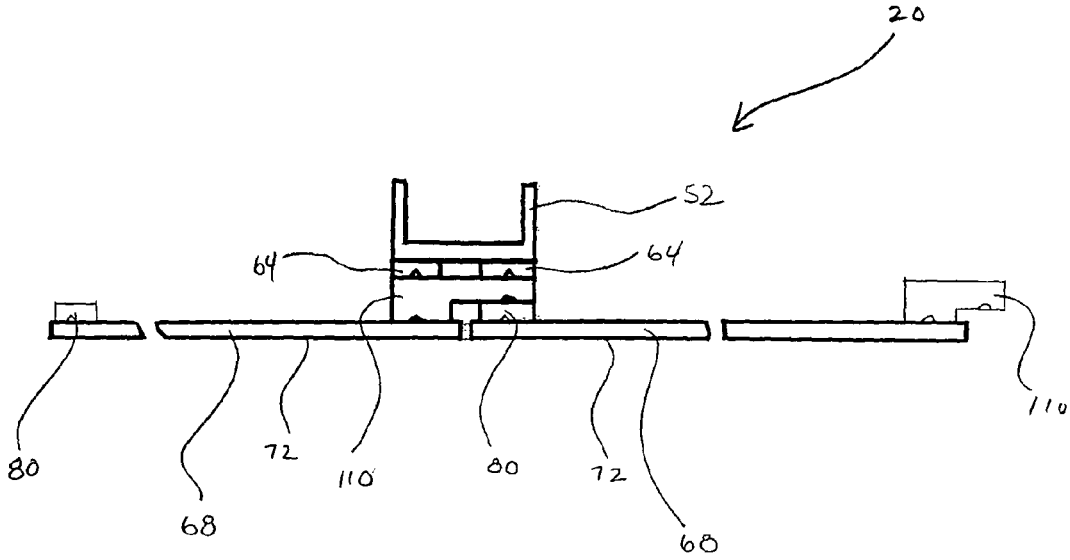
FIG. 19 is a top plan view of the coupling between first and second panel magnets and elongate member according to an embodiment.

Referring to FIG. 19, another embodiment of the magnet configuration is depicted. In this embodiment, each of the face panels 68 can comprise a first face panel magnet 80 and a second panel magnet 110, wherein the second panel magnet 110 can be configured similar to the end panel magnets as described above. In this embodiment, when the second face panel magnet 110 is operably sandwiched intermediate the elongate member 52 or elongate member magnet(s) 64 and the first face panel magnet 80, the second face panel magnet 110 being operably sandwiched intermediate the elongate member 52 and the first face panel magnet 80 can inhibit or prevent the face panels 68 from falling off of the display 20 when bumped, hit, or otherwise deflected. For example, if someone walks by the display 20 and incidentally bumps the face panel(s) 68, the force of the bump will not decouple the second face panel magnet 110 from the elongate member 52 or elongate member magnet(s) 64. Further, because of the stepped configuration of the second face panel magnet 110, the front surfaces 72 of the face panels 68 are substantially flush, providing a continuous, pleasing appearance to the collapsible display structure 20.

Figure 20:
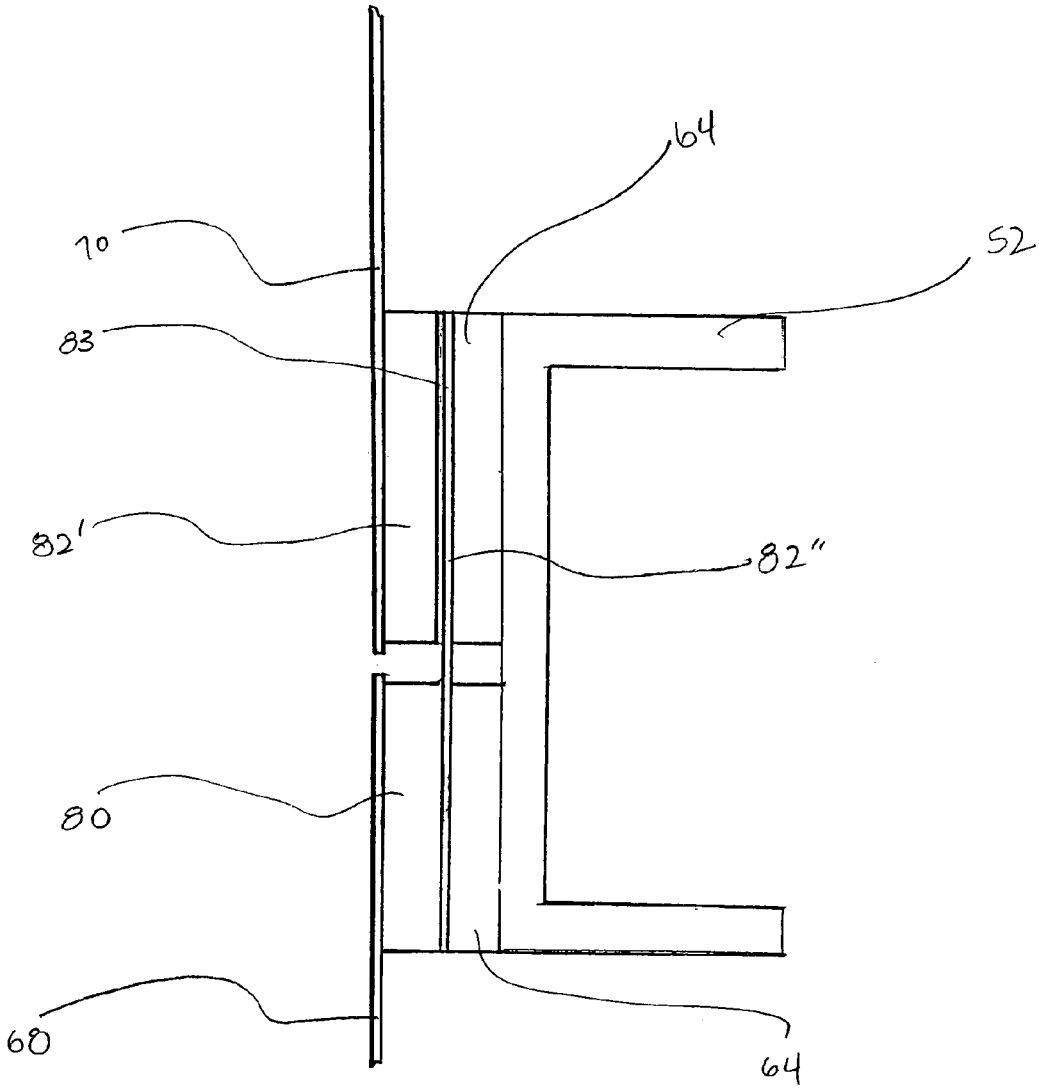
FIG. 20 is a close-up top plan view of the coupling between the end panel magnet, face panel magnet, and elongate member according to an embodiment.

Referring to FIG. 20, while second strip 82" is generally described herein as comprised of a magnet, in a further embodiment, second strip 82" can be formed of a resilient material, such as a thin plastic material or other magnetically transparent material, such that magnetization can pass through the second strip 82". In this embodiment, first strip 82' can be bonded, attached, or otherwise coupled to second strip 82" with, for example, double-sided tape or an adhesive. Once the end panel 70 with end panel magnet comprising first and second strips 82', 82" is positioned on elongate members 52, a face panel 68 with a face panel magnet 80 can be placed on a portion of an outer surface of second strip 82", such that the face panel magnet 80 can magnetically couple with the elongate member magnet 64 through the magnetically transparent second strip 82". This configuration may be utilized either in an original manufactured version or a retrofit.

In another embodiment, second strip 82" can be formed of a metallic or composite material with metallic particles, fibers, or other structures therein, such that second strip 82" is magnetically coupleable with the elongate member magnet 64. Once the end panel 70 comprising first and second strips 82', 82" is positioned on elongate member 52, a face panel 68 with a face panel magnet 80 can be placed on an outer surface 90 of second strip 82", such that the face panel magnet 80 can magnetically couple with second strip 82".

The embodiments above are intended to be illustrative and not limiting. Additional embodiments are within the claims. In addition, although the display and panel magnets have been described with reference to particular embodiments, those skilled in the art will recognize that changes can be made in form and detail. Any incorporation by reference of documents above is limited such that no subject matter is incorporated that is contrary to the explicit disclosure herein.

What is claimed is:

1. A collapsible display comprising:

a framework configurable between erected and collapsed configurations, wherein when in the erected configuration the framework comprises a front and opposed ends and has a height;

an elongate vertical member, configured as a brace, associated with the framework proximate one of the ends when in the open configuration, the vertical member having a magnetic strip thereon for attaching display panels to the framework, the vertical member extending substantially the height of the erected framework;

an end panel curved around in a curved shape and thereby concealing the one of the ends of the framework, the end panel comprising a resilient sheet and an end panel magnet configured as a magnet strip coupled thereto, the end panel magnet strip being operably magnetically engaged with the elongate member by way of the magnetic strip, the end panel having a tendency to return to a flat uncurved configuration when in the curved shape; and a front panel engaged with and thereby concealing at least a portion of the front of the framework, the front panel comprising a front panel magnet configured as a magnet strip coupled thereto, the front panel magnet strip in an overlapping engagement with the end panel magnet strip, such that a portion of the end panel magnet strip is operably sandwiched in a layered arrangement intermediate the magnetic strip on the elongate member and the front panel magnet strip.

2. The collapsible display of claim 1, wherein the end panel magnet comprises first and second portions separated by a transition, the second portion being thicker than the first portion by a transition thickness.

3. The collapsible display of claim 2, wherein the end panel comprises an outer surface and the front panel comprises a front surface, the front panel magnet comprising a front panel magnet thickness that is substantially the same as the transition thickness, such that when the end panel magnet is engaged with the elongate member and the front panel magnet is engaged with the end panel magnet, the outer surface of the end panel and the rear surface of the front panel are substantially flush.

4. The collapsible display of claim 1, further comprising:

a second elongate member presented with the framework proximate the one of the ends when in the open configuration, such that the second elongate member is generally opposed the elongate member; and a second end panel magnet on the end panel generally opposed the end panel magnet, wherein the second end panel magnet is operably engaged with the second elongate member to conceal the one of the ends of the framework.

5. The collapsible display of claim 1, wherein when the one of the ends of the framework is concealed by the end panel, the end panel is in a generally curved configuration.

6. The collapsible display of claim 1, wherein when the end panel comprises a laminate.

7. The collapsible display of claim 1, wherein the end panel magnet and face panel magnet each comprise alternating bands of magnetization, such that the end panel and face panel magnets are inhibited from sliding movement with respect to one another.

8. A panel set for displaying graphics on a collapsible framework, the framework comprising a front and opposed ends and a vertical member configured as a brace presented therewith proximate one of the ends, the panel set comprising:

an end panel concealing an end of a framework, the end panel comprising a resilient end panel sheet portion with four side edges and an end panel magnet along one of said side edges, the resilient end panel sheet portion flexible between a flat unflexed position and a curved flexed position for wrapping around one of the end of the framework, the magnet configured as a strip and having a portion overlapping the resilient sheet portion and having a portion extending outwardly from the overlapping portion and not overlapping said resilient sheet portion, the end panel magnet operably magnetically engaged with the vertical member presented with the framework proximate the end; and a front panel attached to at least a portion of a front of the framework, the front panel comprising a resilient front panel sheet portion and a front panel magnet configured as a magnet strip and selectively engaged with the end panel magnet, such that the end panel magnet strip is in overlapping engagement with the front panel magnet strip and the end panel magnet strip is sandwiched between the front panel magnet and the vertical member in a layered arrangement whereby the end panel is secured therein.

9. The panel set of claim 8, wherein the elongate member comprises an elongate member magnet thereon, such that the end panel magnet is operably sandwiched intermediate the elongate member magnet and the front panel magnet when the front panel magnet is engaged with the end panel magnet.

10. The panel set of claim 8, wherein the end panel magnet comprises first and second portions separated by a transition, the second portion being thicker than the first portion by a transition thickness.

11. The panel set of claim 8, wherein the end panel comprises an outer surface and the front panel comprises a front surface, the front panel magnet comprising a front panel magnet thickness that is substantially the same as the transition thickness, such that when the end panel magnet is engaged with the elongate member and the front panel magnet is engaged with the end panel magnet, the outer surface of the end panel and the rear surface of the front panel are substantially flush.

12. The panel set of claim 8, wherein when the end panel comprises a laminate.

13. The panel set of claim 8, wherein the end panel magnet and face panel magnet each comprise alternating bands of magnetization, such that the end panel and face panel magnets are inhibited from sliding movement with respect to one another.

14. A method of setting up a display comprising:

providing a framework configurable between open and closed configurations, wherein when in the open configuration the framework comprises a front and opposed ends;

presenting an elongate vertical member as a brace with the framework proximate one of the ends when in the open configuration, the elongate vertical member having a magnet strip thereon;

concealing the one of the ends of the framework with an end panel having a flat uncurved configuration and the end panel comprising an end panel magnet configured as a magnet strip thereon by operably engaging the end panel magnet with the elongate vertical member and curving the end panel around the one of the ends in a flexed curved configuration, the curved panel having a significant bias to return to the flat uncurved configuration; and concealing at least a portion of the front of the framework with a front panel comprising a front panel magnet by operably engaging by overlapping the front panel magnet strip with the end panel magnet and operably sandwiching in a layered arrangement the end panel magnet strip intermediate the elongate vertical member and the front panel magnet strip whereby the front panel magnet inhibits or prevents the end panel from returning to it flat configuration when bumped, hit or deflected.

15. The method of claim 14, further comprising presenting an elongate member magnet on the elongate vertical member and operably sandwiching the end panel magnet intermediate the elongate member magnet and the front panel magnet when the front panel magnet is selectively engaged with the end panel magnet.

16. The method of claim 14, further comprising:

presenting a second elongate member proximate the one of the ends when in the open configuration such that the second elongate member is generally opposed the elongate member; and providing a second elongate member magnet on the end panel generally opposed the elongate member magnet, wherein the concealing the one of the ends of the framework comprises operably engaging the second end panel magnet with the second elongate member.

17. The method of claim 14, wherein when the one of the ends of the framework is concealed by the end panel, the end panel is presented in a generally curved configuration.

* * * * *